United States Patent [19]

Stokes

[11] 4,233,827

[45] Nov. 18, 1980

[54] UNSYMMETRICAL BASKET FOR AN ORBITAL CLOTHES WASHER

[75] Inventor: Vijay K. Stokes, Schenectady, N.Y.

[73] Assignee: General Electric Company, Schenectady, N.Y.

[21] Appl. No.: 98,226

[22] Filed: Nov. 28, 1979

[51] Int. Cl.[3] ..... D06F 21/06

[52] U.S. Cl. ..... 68/172

[58] Field of Search ..... 68/147, 148, 152–154, 68/171–174, 232, 233; 220/DIG. 28

[56] References Cited

U.S. PATENT DOCUMENTS

| | | | |
|---|---|---|---|
| 1,665,959 | 4/1928 | Graham et al. | 68/174 X |
| 2,152,477 | 3/1939 | Hays | 68/154 X |
| 3,087,776 | 4/1963 | Anderson | 68/174 X |

FOREIGN PATENT DOCUMENTS

| | | | |
|---|---|---|---|
| 1258187 | 2/1961 | France | 68/154 |

*Primary Examiner*—Philip R. Coe

*Attorney, Agent, or Firm*—Nathan D. Herkamp; James C. Davis, Jr.; Paul R. Webb, II

[57] ABSTRACT

An unsymmetrical basket design is disclosed for an orbital clothes washer. The unsymmetrical design includes a basket bottom having one portion thereof axially lower than another portion with prescribed slopes connecting the upper and lower portions of the basket bottom. In one portion of the basket the inner bottom surface slopes downwardly from the center of the basket to produce turnover in one sense of clothes disposed therein, and in another sloped portion of the basket the inner bottom surface slopes upwardly from the center to facilitate turnover of cloth in a sense opposite the sense of turnover in the one portion, such that mixing of clothes within the basket is enhanced during the orbiting of the basket.

6 Claims, 15 Drawing Figures

UNSYMMETRICAL BASKET FOR AN ORBITAL CLOTHES WASHER

BACKGROUND OF THE INVENTION

This invention relates to a basket for an orbital washer of the type described in U.S. patent application Ser. No. 39,406, filed May 15, 1979 by John Bochan, assigned to the instant assignee and incorporated herein by reference thereto.

An orbital washer as described in the above-cited U.S. patent application, Ser. No. 39,406 employs a drive system such as an eccentric drive, which moves the basket in a particular generally horizontal orbital motion during its clothes washing and rinsing cycles. During the spin cycle the basket is centered and rotated rapidly to remove water from the clothes.

Motion of cloth inside a basket driven in an orbital path as described in the above-mentioned patent application is caused by interaction of the cloth with the basket bottom and the sidewall. Due to the motion of the basket, the cloth tends to move in a helical path continuously about the circumference of the basket. Energy is transferred from the basket to the cloth by interaction of the cloth with the interior surfaces of the basket generating turbulent motion of the cloth and thereby washing of cloth. The shapes of the surfaces of the basket which contact the cloth determine the pattern of motion of cloth within the basket during orbiting thereof. A desirable objective of basket design is to expose all portions of the cloth to be washed to contact with the interior surfaces of the basket to optimize washing action.

SUMMARY OF THE INVENTION

An object of the instant invention is to provide a basket for an orbital washer having an interior configuration which causes cloth disposed within the basket to move in a helical path in one portion of the basket and in a helical path in a second portion of the basket in a sense opposite that of the first helical path.

Accordingly, the instant invention discloses a basket configuration for an orbital washer in which a first portion of the basket bottom wall is at a position lower than a second portion of the basket bottom wall with a continuously-upwardly sloping portion of the basket bottom wall extending generally circumferentially and connecting said lower and upper portions of the basket bottom wall, and a continuously-downwardly sloping portion of said basket bottom wall extending generally circumferentially and connecting said upper and lower portions of said basket bottom and being disposed generally opposite the upwardly sloping bottom portion. The inner surface on the outer wall of the basket adjacent the upwardly sloping portion of the basket bottom has a resistance to relative motion of damp cloth in contact therewith greater than that exhibited by the basket bottom wall, and a protrusion from said bottom wall providing an interior wall is disposed adjacent the downwardly sloping portion which has a surface with a low resistance to relative motion of damp cloth in contact therewith.

BRIEF DESCRIPTION OF THE DRAWINGS

The features of the invention believed to be novel and unobvious over the prior art are set forth with particularity in the appended claims. The invention itself, however, as to organization, method of operation and advantages thereof, may best be understood by reference to the following description taken in conjunction with the accompanying drawings in which:

DESCRIPTION OF THE PREFERRED EMBODIMENTS

Figure 1:
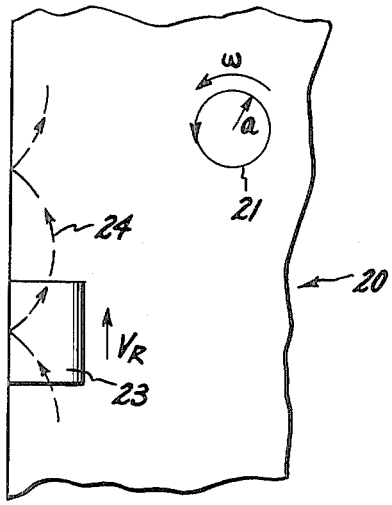
FIGS. 1 and 2 schematically illustrate a channel which illustrates the principle of operation of a basket in an orbital washer.

The specific features of the instant invention described herein and shown in FIGS. 1-15 are merely exemplary, and the scope of the invention is defined in the appended claims. Throughout the description and FIGS. 1-15, like reference characters refer to like elements of the invention.

Figure 2:
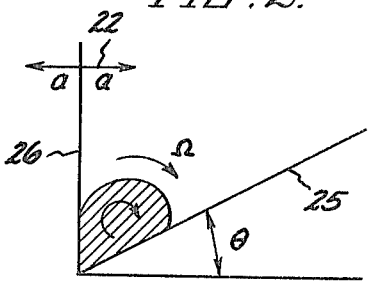

FIGS. 1 and 2 illustrate a model which demonstrates the action of an orbiting channel 20 and which is useful in describing the motion of a generalized element within an orbiting channel. Channel 20 moves in a horizontal circular orbit of radius a and angular frequency $\omega$ as shown by circular arrow 21 in FIG. 1, such that each point of channel 20 will move in a circle of a radius a at an angular frequency $\omega$ in a horizontal plane such that when viewed in elevation, FIG. 2, each point will execute a simple harmonic motion with amplitude a and angular frequency $\omega$ as shown by arrow 22 in FIG. 2.

If channel 20 is orbited with an appropriately selected angular frequency $\omega$ and amplitude a, an object such as a piece of cloth 23 disposed within channel 20 will move along channel 20 in an intermittent hopping motion in a path such as the one shown by the dashed line 24, FIG. 1. For a counterclockwise orbiting motion of channel 20, the piece of cloth 23 will have an average velocity $V_R$ relative to channel 20 as shown in FIG. 1. In addition to this motion, the piece of cloth 23 will undergo intermittent rotary motion, called turnover, which is measured by an average rotation velocity, Ω, as illustrated in FIG. 2. The rotary motion and the linear translation of the cloth together produce a helical movement of the cloth relative to the channel 20. The angle $\theta$ between the channel bottom 25 and a horizontal reference line determines the rotation velocity, Ω, for a given object and a given orbiting motion of the channel with amplitude a and frequency $\omega$. By increasing $\theta$, Ω tends to increase, thereby producing more contact between the cloth and the channel bottom wall 25.

Figure 3:
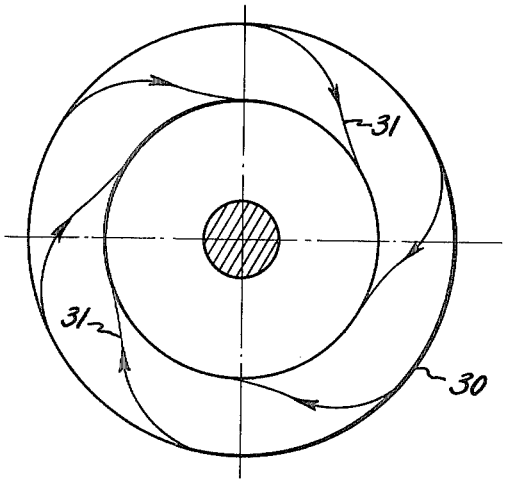
FIGS. 3 and 4 schematically illustrate a model employing the principle illustrated in FIGS. 1 and 2 as applied to an annular basket.
Figure 4:
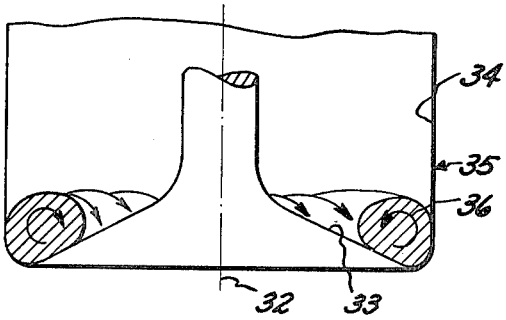

Wrapping the vertical side 26 of channel 20 shown in FIGS. 1 and 2 to form a cylinder generates the circular channel 30 shown in FIGS. 3 and 4. Applying orbiting motion to the circular channel 30 causes an object, such as a piece of cloth, disposed in circular channel 30 to travel in a circular path around the circular channel 30, called turn-around. In contrast to the motion in straight channel 20 of FIGS. 1 and 2, a phase difference is introduced into the motion of cloth in the circular channel 30 shown in FIGS. 3 and 4, so that the turn-around and turnover give rise to a motion of each part of the cloth along a helix as shown by the arrows 31 in FIG. 3.

An analysis of the motion in circular channel 30 indicates that the direction of turn-around motion is in a sense opposite that of the orbiting motion of channel 30, i.e., in FIG. 3 the motion of the cloth will be in a clockwise direction as channel 30 moves in a counterclockwise orbit about the axis 32 of the circular channel 30. A reversal in the direction of orbit motion causes a reversal in the direction of the relative motion of an object in the channel. The turnover motion Ω is always in the same sense, i.e., downwardly along an inclined bottom surface 33 and up the vertical surface 34 of side wall 35 as shown by arrow 36 in FIG. 4. The sense of this turnover motion is not changed by a reversal of the orbiting motion. For fixed values of orbit amplitude a, angular frequency $\omega$ and basket bottom slope $\theta$, the turn-around is facilitated by a rough vertical wall surface 34. The turnover on the inclined bottom surface 33 is facilitated or enhanced by a surface which presents a relatively smooth surface to motion of cloth down along surface 33 and a relatively rough surface to motion of the cloth up the slope.

Figure 5:
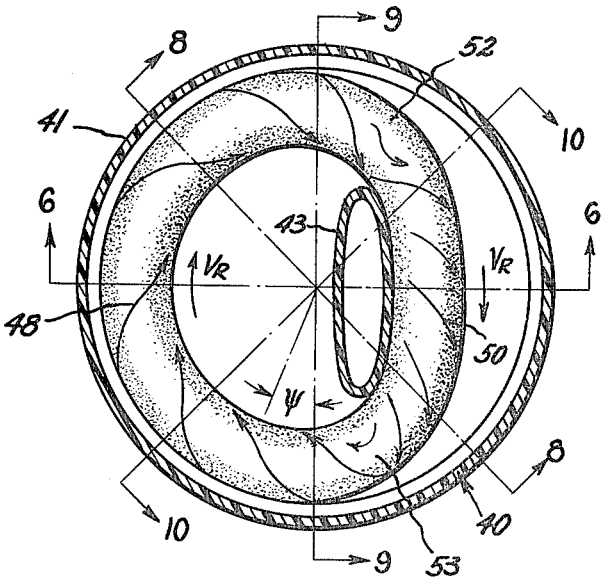
FIG. 5 is a schematic partial cross-sectional view looking down on a basket incorporating the instant invention.

Employing the above description of relative-motion between basket and clothes in an orbiting basket, an unsymmetrical basket shape, as shown in FIG. 5 is proposed. The basket 40 comprises a generally vertical cylindrical outer wall 41, bottom wall 42 and a generally vertical protrusion, hereinafter called the center post 43, projecting from said bottom wall 42. One portion 44 of the bottom wall 42 slopes downwardly from center post 43 toward outer wall 41 and another portion 45 slopes upwardly from center post 43 toward outer wall 41. The basket is usually made of a polymeric plastic material or a metallic material coated with a layer of polymeric material or porcelan enamel which is not subject to corrosion.

This construction produces turnover motion of the clothes load in one sense as shown by arrow 46 as clothes move over one portion 44 of the basket bottom wall 42 and turnover motion in the opposite sense as shown by arrow 47 as clothes move over portion 45 of the basket bottom wall 42, while the clothes move continuously around the basket 40. As shown by the arrows 48 in FIG. 5, the clothes load moves in a helical motion with the cloth rising along the inner surface 49 of outer wall 41 of the basket 40 as it travels over portion 44 of bottom wall 42. The clothes load moves in a helical pattern as shown by arrows 50 with a rising motion at the outer surfaces 51 of the center post 43 as it travels over portion 45 of bottom wall 42. Although arrows 46 and 47 appear to identify turnover in the same sense, since the clothes move continuously around the basket, the clothes actually reverse the sense of the rotation in order to produce first a rotation upward along the outer wall 41 and upward along the inner surface 51 of post 43. This turnover in one sense followed by a turnover in the opposite sense causes clothes within the basket to be mixed within the load, so that one portion of the fabric thereof is not continuously exposed to the basket walls.

According to the analysis provided by the models shown in FIGS. 1–4, assuming a counterclockwise orbit of basket 40, the relative velocity $V_R$ of cloth in the circular basket 40 would be clockwise along portion 44 of basket bottom 42 and counterclockwise along portion 45 of basket bottom 42. To prevent pileup of the clothes near the position 52, a force directed clockwise will have to be applied to the clothes to overcome the natural tendency of the clothes to move counterclockwise by contact with surface 51 of post 43 and to move the clothes to the position 53. This can be achieved by making basket 40 in such a way that the bottom surface at 52 is at a higher level than the bottom surface at 53, and by giving a continuously downward slope to the portion 45 of basket bottom 42 in the circumferential direction from 52 to 53 large enough to make clothes move clockwise at the same rate $V_R$ as the motion along portion 44. The basket design then requires that the bottom surface of portion 44 slope continuously upwardly in the circumferential direction from 53 to 52 to complete the basket bottom slope. Clothes can be made to move readily up the slope from 53 to 52, by providing a rough surface having a high resistance to relative motion of damp cloth in contact therewith compared to that of the bottom wall to at least a portion of the surface 49 of basket wall 41 adjacent bottom portion 42. The bottom portion 43 is designed to have a large enough slope, and is given a smooth surface 54 having a low resistance to relative motion of damp cloth in contact therewith, to cause the clothes to readily slide down in the circumferential direction from 52 to 53 against a smooth surface 51 of post 43.

Figure 7:
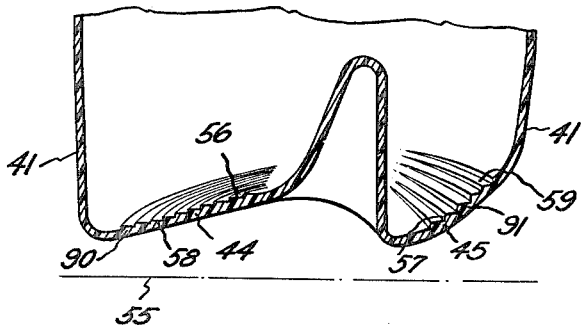
FIG. 7 is a schematic vertical elevation cross-sectional view of the basket of FIG. 5 taken along line 6—6 thereof and showing interior features thereof.
Figure 8:
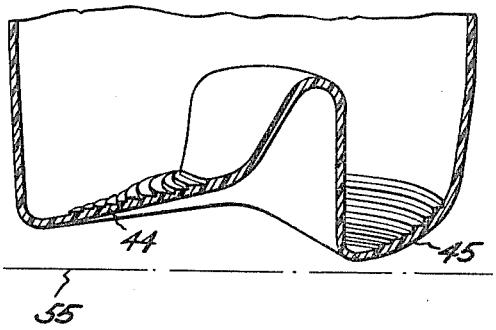
FIG. 8 is a schematic vertical elevation cross-sectional view taken along line 8—8 of FIG. 5.
Figure 9:
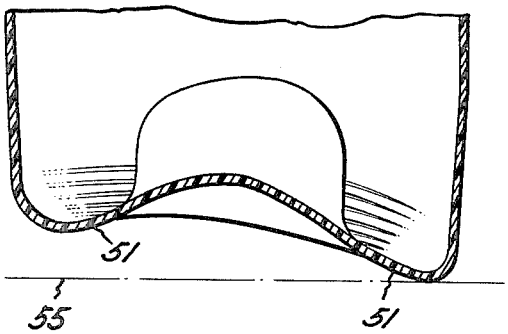
FIG. 9 is a schematic vertical elevation cross-sectional view of the basket of FIG. 5 taken along line 9—9 of FIG. 5.
Figure 10:
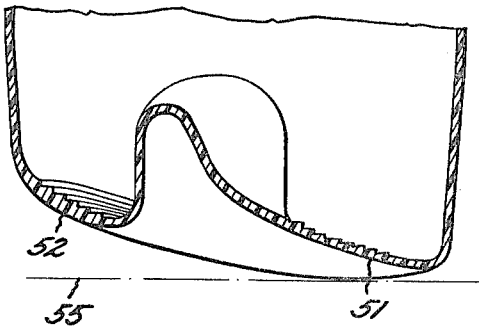
FIG. 10 is a schematic vertical elevation cross-sectional view taken along line 10—10 of FIG. 5.

FIGS. 7–10 show cross-sectional views illustrating the elevation of basket bottom 42 relative to a fixed reference line 55 at specific locations about the circumference thereof. As shown in FIG. 7, portion 44 of basket bottom 42 slopes generally continuously downwardly toward the outer basket wall 41 and portion 45 of the basket bottom 42 slopes generally continuously upwardly from center post 43 toward the outer basket wall 41. This is the shape of the basket bottom wall at approximately the mid-point of each of portions 44 and 45, respectively, of basket bottom 42. FIG. 8 shows the shape of basket bottom 42 at a position about 45° from the midpoint of each of bottom portions 44 and 45. The left-hand part of FIG. 8 shows the bottom shape of upwardly sloping portion 44 of basket bottom 42, and the right-hand part of FIG. 8 shows the downwardly sloping portion 45 of the basket bottom 42 at a point near the lower limit of the downwardly sloping section of the basket bottom. FIG. 9 shows in the left-hand part thereof a contour of upward sloping portion 44 of the bottom 42 at a point near the upper limit of the upwardly sloping portion of the basket bottom, and the right-hand part of FIG. 9 shows a view of the upwardly sloping portion 44 at a position near its lowermost point. The left-hand part of FIG. 10 shows the contour of the basket bottom 42, at a point just below the upper limit of the downwardly sloping portion 45 of the basket bottom, and in the right-hand part of FIG. 10 shows a view of the upwardly sloping portion 44 at a position about 45° down slope from the midpoint shown in FIG. 7.

The stepped structure of the basket bottom 42 shown in FIGS. 7–10 is employed to enhance turnover of clothes coming into contact with the basket bottom, thereby further enhancing mixing of the clothes within the basket. Cloth encountering vertical sides 56, 57 of the stepped ramps would encounter a high resistance to motion up the stepped slope in the radial direction and thereby be caused to roll over, while cloth moving downwardly along the generally horizontal surfaces 58, 59 of the stepped ramps would encounter very low resistance to relative sliding motion of the cloth in contact therewith. The steps 90, 91 could extend continuously around the circumference of the basket in each of the generally upwardly and generally downwardly sloping portions 44, 45, respectively, of the basket bottom 42. Alternative constructions, such as a perforated surface, on the basket bottom to enhance resistance to relative motion in the radial direction of cloth in contact with the basket bottom could be employed. The steps would preferably have a smooth surface in the circumferential direction to facilitate turn-around movement of the cloth within the basket 40. The cloth rises within the basket in contact with the basket wall 41 and falls in contact with the center post 43, thereby mixing and rolling the cloth, so that all parts thereof come into contact with the basket wall 41 which contact produces maximum washing of the cloth.

Figure 11:
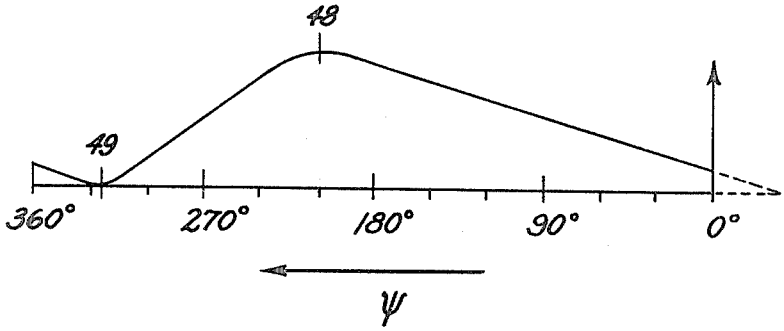
FIG. 11 is a graphical illustration of the variation of basket bottom elevation relative to circumferential position of the basket shown in FIG. 5.

One particular configuration of basket bottom, showing position above the reference versus circumferential position, $\psi$, in degrees, is schematically illustrated in FIG. 11. It can readily be seen that a greater portion of the total circumference of the basket bottom 42 has an upward slope in the circumferential direction of turn-around motion of the cloth and a shorter portion has a downward slope in the direction of turn-around motion of the cloth. The relative circumferential length and the slope of each of the upwardly and downwardly sloping portions are chosen in conjunction with the surface roughness of each of the inner surfaces of the basket to produce uniform turn-around velocity around the circumference of the basket to maintain uniform distribution of clothes around the basket.

Figure 12:
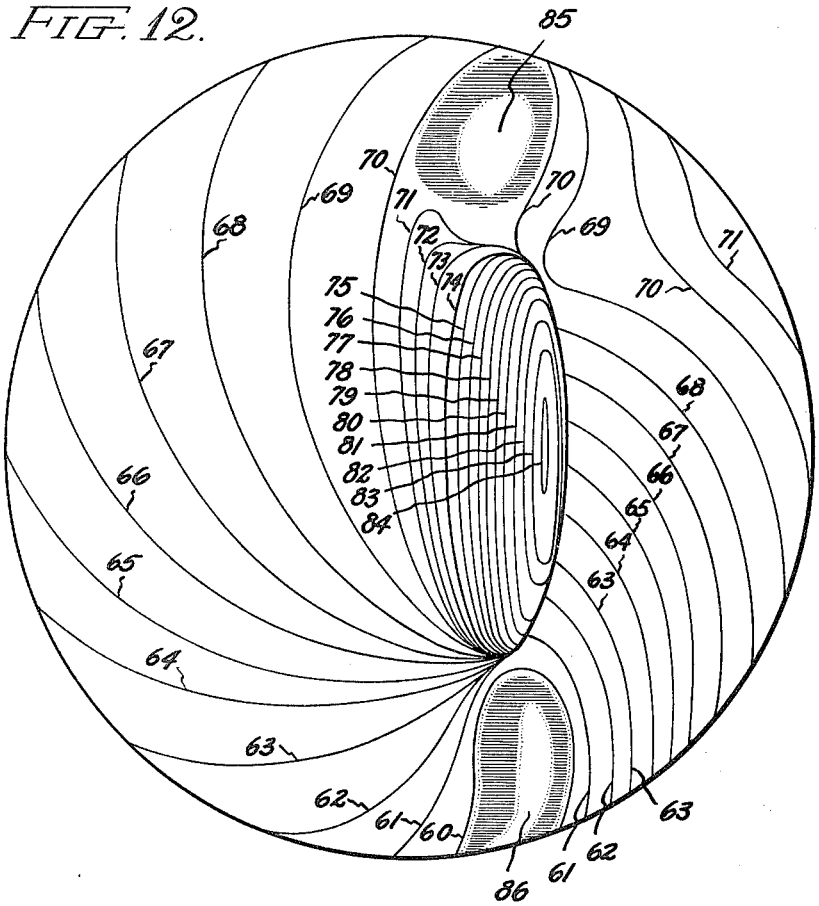
FIG. 12 is a schematic view illustrating the contours along the bottom of the basket shown in FIG. 5.

FIG. 12 shows approximate contours 60–84 of uniform elevation of the basket bottom wall surface. The precise change in bottom elevation between adjacent contours would be determined by calculating the necessary slopes based upon a particular given orbit frequency $\omega$ and amplitude a. As clothes in the basket pass over the flat portions 85, 86 of the basket bottom 42, the tendency to turn over stops, because the bottom 42 has no slope $\theta$ driving turnover. As clothes proceed to the downwardly sloping portion 45 of the basket bottom, it tends to turnover in a sense opposite that of the turnover in the up-hill portion 44 of the basket bottom 42. At a position in the vicinity of flat portions 85, 86 the turnover will reverse depending upon the slope relationship, since the cloth will act as a continuous body extending around the basket.

Figure 13:
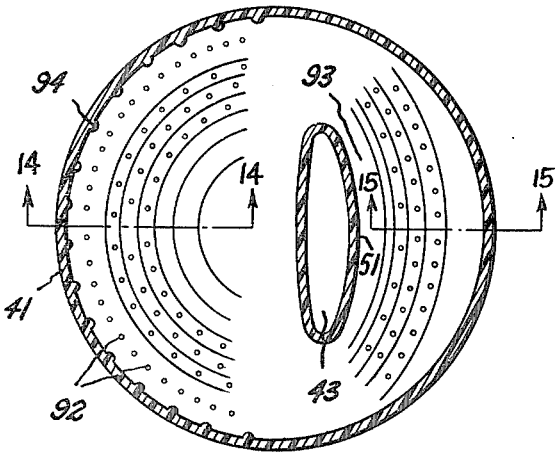
FIG. 13 is a schematic view of the basket of FIG. 5 showing a pattern of bottom structure and sidewall detail.
Figure 14:
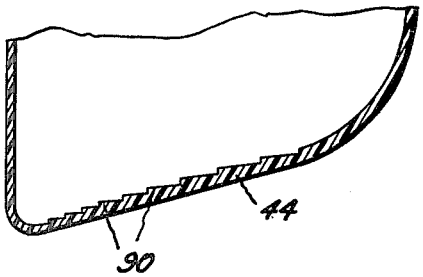
FIG. 14 is a partial cross-sectional view of the basket bottom shown in FIG. 13 taken along line 14—14 thereof.
Figure 15:
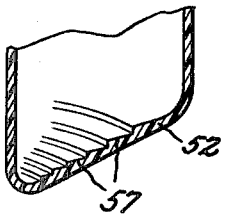
FIG. 15 is a partial cross-sectional view of the basket bottom shown in FIG. 13 taken along line 15—15 thereof.

Interaction of the cloth with the basket bottom shaped as shown in FIGS. 13–15, tends to enhance turnover. In the upwardly sloping portion 44 of the basket, the bottom is shaped as a plurality of steps 90 as shown in FIG. 14, which tends to enhance turnover of the cloth in the sense shown by arrow 46 in FIG. 6. The steps 91 on bottom construction for portion 45 shown in FIG. 15 tends to enhance fabric turnover in the sense shown by arrow 47 in FIG. 6. By increasing the number or vertical height of steps in each portion of the basket bottom, the turnover velocity $\Omega$ can be increased so that mixing of the fabric is facilitated. Drain holes 92 in the pattern shown in FIG. 13 are provided to allow flow through of wash water and detergent or rinse water. It is noted that no holes are provided in the downwardly sloped channel 93 adjacent center post 43, so that water flowing down channel 93 will facilitate sliding of clothes over the surface of channel 93.

As shown in FIG. 13, sidewall friction which drives the cloth around the circumference of the basket may be increased by providing vertical ribs 94 along the inner surface 49 of outer basket wall 41 of the upslope portion 44 of the basket. This increased roughness surface causes an increase in the tendency of clothes to move in the circumferential direction while in contact with surface 49, which enhances movement of cloth up the slope driven by the orbiting motion of the basket. The vertical surface 51 of the center post 43 is smooth so that the tendency of the frictional contact between the post 43 and the cloth to inhibit movement of the cloth down the slope is minimized. In the downwardly sloping portion 45 of the basket, gravity is employed to move the cloth circumferentially down from 52 to 53, with the stepped bottom surface providing enhanced turnover of the cloth, while it is passing over bottom portion 45.

Figure 6:
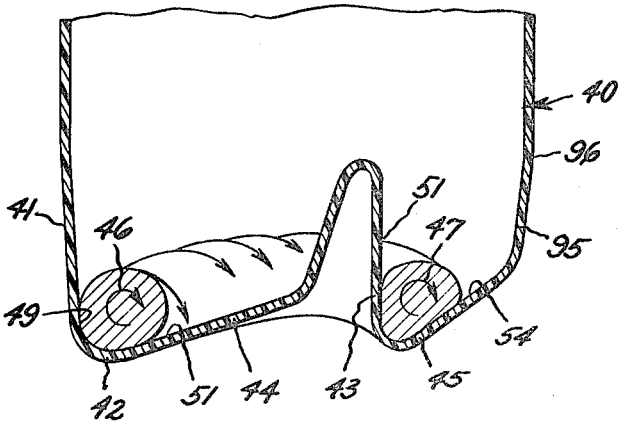
FIG. 6 is a vertical elevation cross-sectional view of the basket of FIG. 5 taken along line 6—6 thereof.

The tendency of the unsymmetrical basket to be unbalanced during a spin cycle to partially dry the clothes being washed can be eliminated by giving a slight outward flair to the outer cylindrical wall 41 of the basket up to a certain height. For example, as shown in FIG. 6, the lower part 95 of wall 41 flairs outwardly to point 96 and then forms a straight, vertical cylinder upward from 96. Because of this flairing, centrifugal force will move the clothes upwardly and outwardly to the point 96 throughout the circumference of the basket during the spin cycle, during which the basket 40 is centered by the drive mechanism as described in the above-referenced patent application Ser. No. 39,406, thereby ensuring mechanical balance.

The above-described invention enhances fabric mixing and turbulence within the basket of an orbiting washer to maximize transfer of energy from the basket to all parts of a fabric load within the basket to facilitate washing thereof with detergent and water in a flow through washing system.

I claim:

1. A basket for an orbital washer comprising:

an annular outer wall;

a basket bottom wall;

a post projecting vertically upwardly from said basket bottom wall generally parallel to said outer wall and disposed generally centrally thereof;

said basket bottom wall comprising:

a first bottom portion sloping generally upwardly in the radial direction from said outer wall toward said post; said first bottom portion sloping continuously upwardly in the generally circumferential direction from a first circumferential position to a second circumferential position located axially above said first position; and a second bottom portion sloping generally downwardly from said outer wall toward said post in the radial direction; said second bottom portion sloping continuously downwardly in the generally circumferential direction from said second positon to said first position; said first portion being disposed generally circumferentially opposite said second portion; and said outer wall having on a first portion thereof adjacent said first bottom portion an inner surface having, over a substantial portion of its height extending vertically upward from the intersection of said outer wall and said first bottom portion, a resistance to relative motion of damp cloth in contact therewith greater than the resistance of said bottom wall to relative motion of said same damp cloth in contact with said bottom wall in the radially outward direction; and said outer wall having on a second portion thereof an inner surface adjacent said second bottom portion having a resistance to relative motion of said same damp cloth in contact therewith less than said resistance to relative motion of said first portion of said outer wall; and said post having a generally vertical smooth surface disposed adjacent said second bottom portion having a resistance to relative motion of said same damp cloth in contact therewith less than said resistance to relative motion of said first portion of said outer wall.

2. The apparatus of claim 1 wherein the bottom surface of said first bottom portion comprises a plurality of generally circumferentially-extending steps providing an upward graduation of said first bottom portion of said basket bottom wall from said outer wall toward said post and said second bottom portion comprises a plurality of generally circumferentially-extending steps providing an upward graduation at said second bottom portion of said basket bottom wall from said post toward said outer wall.

3. The apparatus of claim 2 further comprising a plurality of drain holes extending through said basket bottom wall in each of said first and second portions thereof.

4. The apparatus of claim 3 wherein said annular outer wall includes a first section of a vertical cylindrical shape and a second section having an outwardly flared shape extending from the intersection of said bottom wall with said annular wall to a point intersecting said cylindrical first section of said outer wall.

5. The apparatus of claim 4 wherein said outer annular wall includes a plurality of generally vertically extending ribs attached to the inner surface of said outer wall adjacent said first bottom portion.

6. The apparatus of claim 5 wherein said second bottom portion further comprises a smooth channel adjacent said post and extending generally circumferentially downwardly from said second location to said first location.

* * * * *